US005430274A

United States Patent [19]

Couffet et al.

[11] Patent Number: 5,430,274

[45] Date of Patent: Jul. 4, 1995

[54] IMPROVEMENTS MADE TO THE COOLING OF COILS OF AN INDUCTION HEATING SYSTEM

[75] Inventors: Claude Couffet, Montreuil; Jean Hellegouarc'h, Le Perreux/Marne; Gérard Prost, Fresnes; Jean C. Uring, Colmar, all of France

[73] Assignee: Celes, Lautenbach, France

[21] Appl. No.: 319,476

[22] Filed: Oct. 7, 1994

Related U.S. Application Data

[63] Continuation of Ser. No. 80,848, Jun. 24, 1993, abandoned.

[30] Foreign Application Priority Data

Jun. 24, 1992 [FR] France ..... 92 07738

[51] Int. Cl.[6] ..... H05B 6/42

[52] U.S. Cl. ..... 219/677; 219/632; 219/672; 174/15.1; 336/55; 336/223

[58] Field of Search ..... 219/629, 630, 632, 677, 219/672; 174/15.1, 15.2; 376/62, 57, 55, 222, 223

[56] References Cited

U.S. PATENT DOCUMENTS

| | | | |
|---|---|---|---|
| 2,747,068 | 5/1956 | Lackner | 219/10.491 |
| 3,256,417 | 6/1966 | Merrett | 219/10.79 |
| 3,260,792 | 7/1966 | Kreisel | 219/10.79 |
| 3,492,453 | 1/1970 | Hurst | 219/632 |
| 3,946,349 | 3/1976 | Haldeman, III | 219/10.79 |
| 4,590,347 | 5/1986 | Thatcher et al. | 219/632 |
| 5,003,145 | 3/1991 | Nolle et al. | 219/10.491 |
| 5,208,433 | 5/1993 | Hellegouarc'h et al. | 219/677 |

FOREIGN PATENT DOCUMENTS

| | | |
|---|---|---|
| 0462011 | 12/1991 | European Pat. Off. . |
| 1429652 | 1/1966 | France . |
| 1542715 | 9/1968 | France . |
| 507556 | 9/1930 | Germany . |
| 3019222 | 11/1980 | Germany . |

*Primary Examiner*—Philip H. Leung
*Attorney, Agent, or Firm*—Pollock, Vande Sande & Priddy

[57] ABSTRACT

Electromagnetic-induction heating coil, especially for the heating of metallurgical products, in which coil conductors are cooled with the aid of a tube in which a cooling fluid, in thermal contact with the conductors, circulates, wherein the conductors are wound in at least one ply, as a helix around the cooling tube so that the ply has at least one twist of one complete turn between two electrical terminals of the coil.

5 Claims, 3 Drawing Sheets

IMPROVEMENTS MADE TO THE COOLING OF COILS OF AN INDUCTION HEATING SYSTEM

This application is a continuation of U.S. patent application Ser. No. 08/080,848, filed Jun. 24, 1993.

FIELD OF THE INVENTION

The present invention relates to improvements made to the production of the coils used in electromagnetic-induction heating systems.

BACKGROUND OF THE INVENTION

It is known that such systems, generally used for the heating of metallurgical products on the move, especially flat products, include a magnetic circuit having an air gap, a coil surrounding this magnetic circuit in the vicinity of the air gap and an electric generator supplying a current to a capacitive assembly connected to the terminals of the coil.

The temperatures employed in such electromagnetic-induction heating systems require the provision of means for protecting the coil and the neighboring structure. It is furthermore advisable to prevent any magnetic leakage flux in the region of the coil which would be liable to induce currents in the conductors of this coil, and therefore parasitic heating of these conductors. It has therefore been expedient to conceive of means enabling such parasitic heating to be limited. For example, by cooling the coil with the aid of an appropriate cooling circuit.

One of the currently known solutions therefore consists in incorporating a cooling tube in the conductor. It is this type of solution that the present invention is proposed to improve, especially so as to simplify, significantly, the production of such cooled coils while still making sure that cooling is particularly effective.

As a consequence, the present invention relates to an electromagnetic-induction heating coil, especially for the heating of metallurgical products, in which coil conductors are cooled with the aid of a tube in which a cooling fluid, in thermal contact with the conductors, circulates, characterized in that the said conductors are wound in at least one ply, as a helix around the cooling tube so that the said ply has at least one twist of one complete turn between two electrical terminals of the coil.

According to one embodiment of the present invention, the conductors are wound around the cooling tube in a plurality of plies which are crossed, superposed and wound as helices of opposite pitches.

According to another embodiment of the invention, the conductors are wound around the cooling tube in a plurality of plies which are braided over the said tube.

According to a preferred embodiment of the invention, the conductors are wound as helices around the cooling tube so as to have four turns per meter.

BRIEF DESCRIPTION OF THE FIGURES

Other characteristics and advantages of the present invention will emerge from the description given hereinbelow, with reference to the attached drawing which illustrates embodiments thereof which are devoid of any limiting character and in which.

DETAILED DESCRIPTION OF THE INVENTION

Figure 1:
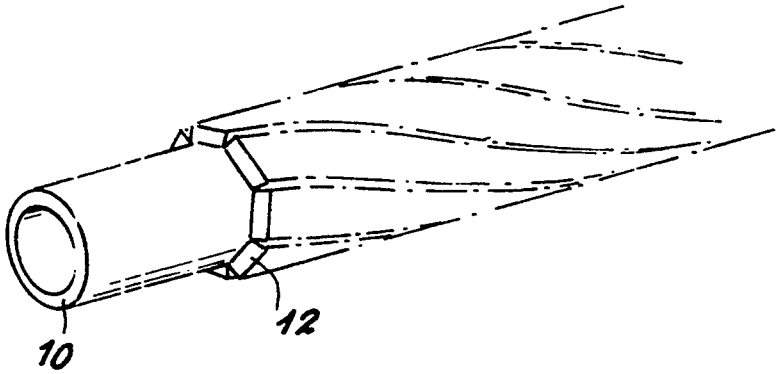
FIGS. 1 to 3 are perspective diagrammatic views illustrating three embodiments of a conductor for inductive heating coils according to the present invention.
Figure 4:
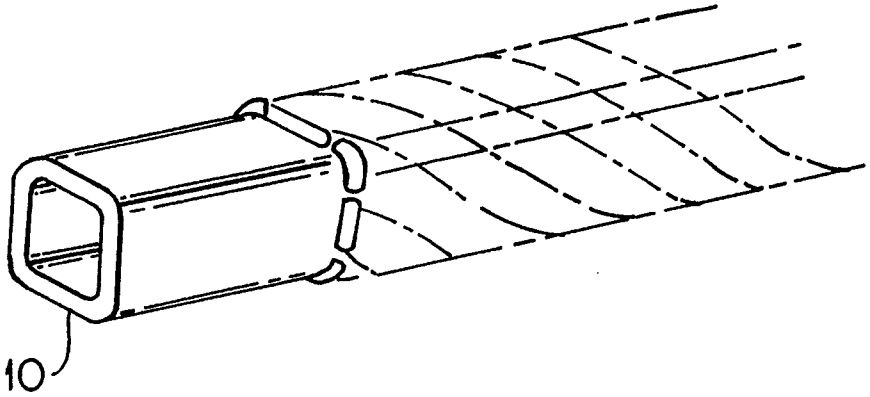
FIG. 4 is a view similar to that of FIG. 1, but illustrating a square-shaped cross-section for a cooling tube.
Figure 5:
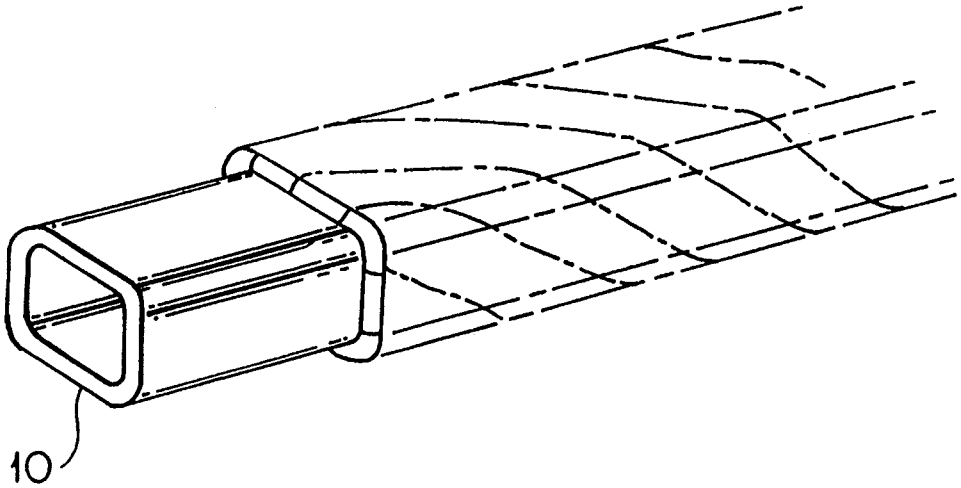
FIG. 5 is a view similar to that of FIG. 1, but illustrating a rectangular-shaped cross-section for a cooling tube.

In the drawing, 10 represents the tube in which a cooling fluid circulates and in thermal contact with which the conductors of the coil are positioned. This tube 10 may have any appropriate cross-section, such as, for example, a cross-section which is circular, square, rectangular, etc., as illustrated in FIGS. 1, 4, and 5. In the embodiment illustrated by FIG. 1, these conductors 12, which may be of any appropriate type (having a cross-section which is circular, square, rectangular, etc.), are wound as a helix, in a ply, around the cooling tube 10. The winding is carried out so that the ply of conductors 12 has at least one twist of one complete turn between two electrical terminals (which are not shown) of the coil.

According to a non-limiting example of the invention, it is possible to provide four turns per metre.

By virtue of the arrangement adopted by the present invention, the conductors are twisted naturally and without stress around the cooling tube, which reduces the fragility of these conductors.

Figure 2:
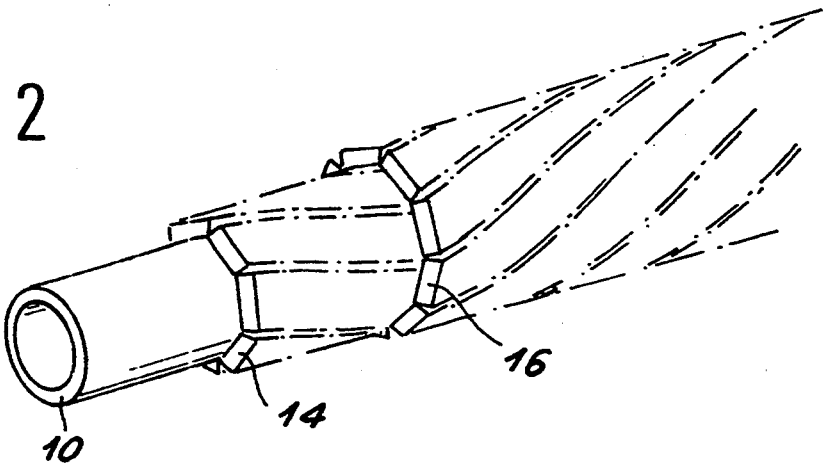

In the embodiment illustrated by FIG. 2, the conductors of the coil are wound around the cooling tube 10 in a plurality of crossed plies, two crossed plies 14 and 16 in this example, which are superposed and wound as helices of opposite pitches around the tube 10.

Figure 3:
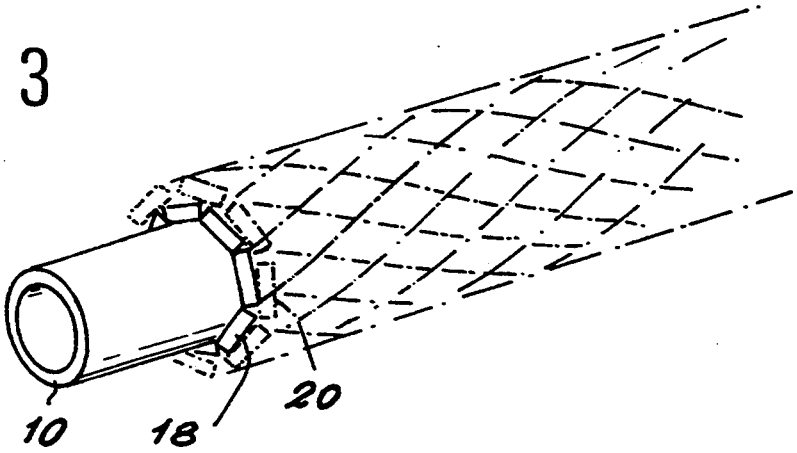

In the variant which is illustrated in FIG. 3, the conductors are wound as helices around the cooling tube in braided plies 18 and 20. A similar electrical behavior of each conductor layer in relation to the other is thus obtained.

Figure 6:
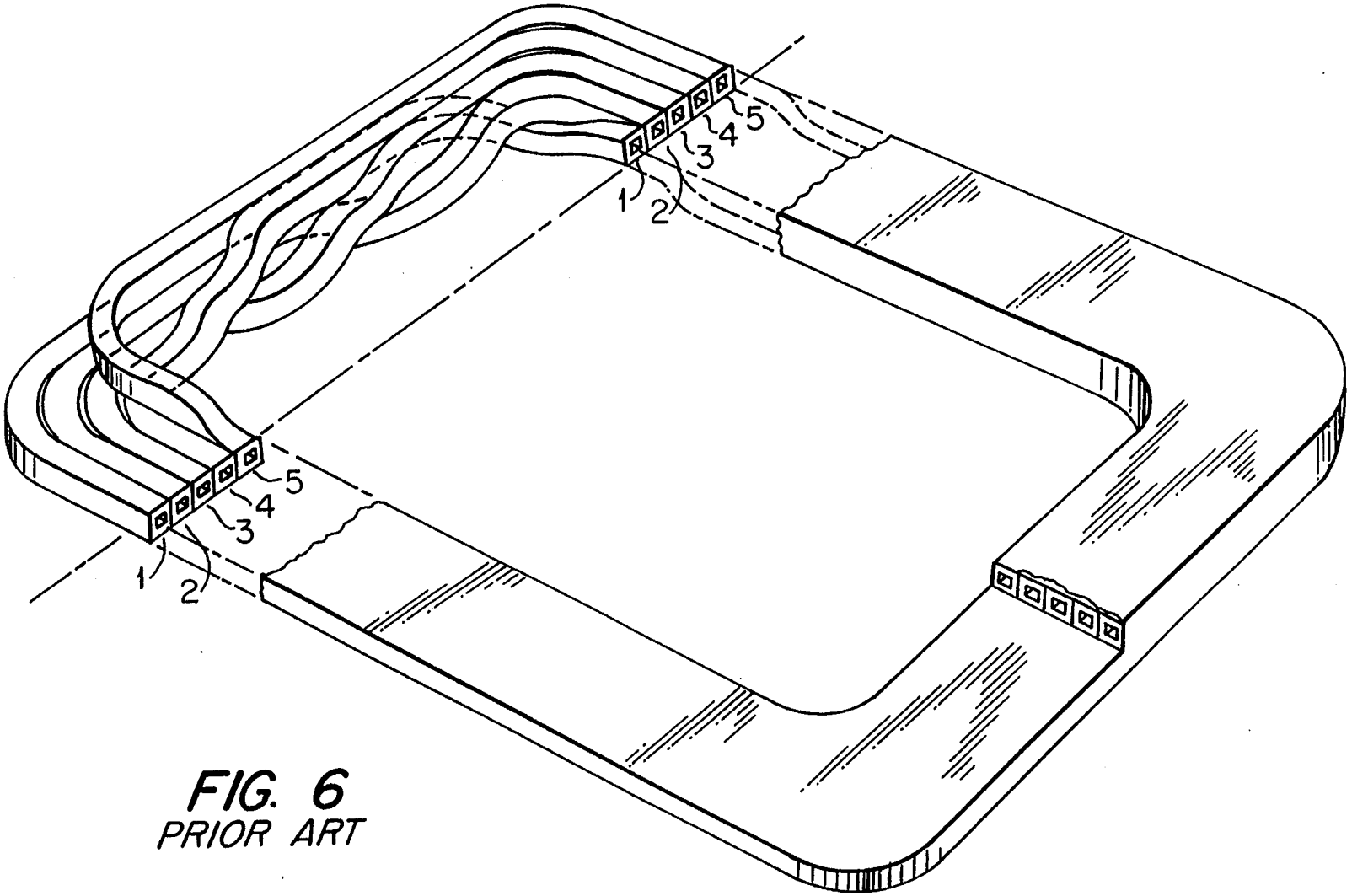
FIG. 6 PRIOR ART
FIG. 6 is a partial cutaway view illustrating the routing of parallel positioned cooling tubes forming a coil.

According to one variant of the present invention, the induction heating coil may be constituted by a plurality of cooling tubes, such as those described hereinabove, which support the conductors and are coiled in parallel while undergoing the necessary routing well known to the person skilled in the art, as shown in FIG. 6.

It remains understood that the present invention is not limited to the embodiments described and/or represented here, but that it encompasses all the variants thereof.

We claim:

1. An electromagnetic induction heating coil comprising:

a thermally conductive unitary cooling tube;

a first conductor layer wound as a helix around an outer surface of the cooling tube, the cooling tube in thermal contact with only an inner surface of the helical layer;

a second conductor layer, wound as a helix in an opposite sense, around the first conductive layer, and in thermal contact therewith, the helix of the second layer skewed relative to the cooling tube;

both helical layers coaxial with the cooling tube; and cooling fluid circulating through only the interior of the tube for producing heat transfer from the conductor layer, through the tube, thereby cooling the conductor layer.

2. An electromagnetic induction heating coil comprising:

a thermally conductive unitary cooling tube;

a first layer of conductor strands wound helically around an outer surface of the cooling tube;

a second layer of conductor strands wound helically and in an opposite sense from the first layer, and braided in thermal contact therewith;

the strands of each layer skewed relative to the cooling tube and coaxial with the cooling tube; and cooling fluid circulating through only the interior of the tube for producing heat transfer from the braided conductor layers, through the tube, thereby cooling the conductor layers.

3. The heating coil set forth in claim 1 or claim 2 wherein the cross section of the cooling tube is square.

4. The heating coil set forth in claim 1 or claim 2 wherein the cross section of the cooling tube is rectangular.

5. The heating coil set forth in claim 1 or claim 2 wherein the cross section of the cooling tube is circular.

* * * * *